US011578474B2

(12) United States Patent
De Gier

(10) Patent No.: US 11,578,474 B2
(45) Date of Patent: Feb. 14, 2023

(54) HYDRAULIC CYLINDER, FOR EXAMPLE FOR USE WITH A HYDRAULIC TOOL

(71) Applicant: DEMOLITION AND RECYCLING EQUIPMENT B.V., Cuijk (NL)

(72) Inventor: Gertrudis Maria Gerardus De Gier, Cuijk (NL)

(73) Assignee: DEMOLITION AND RECYCLING EQUIPMENT B.V., Cuijk (NL)

( * ) Notice: Subject to any disclaimer, the term of this patent is extended or adjusted under 35 U.S.C. 154(b) by 0 days.

(21) Appl. No.: 17/337,767

(22) Filed: Jun. 3, 2021

(65) Prior Publication Data

US 2021/0381199 A1 Dec. 9, 2021

(30) Foreign Application Priority Data

Jun. 5, 2020 (NL) ..... 2025765

(51) Int. Cl.

| | |
|---|---|
| ***E02F 9/22*** | (2006.01) |
| ***F15B 15/14*** | (2006.01) |
| ***E02F 3/96*** | (2006.01) |
| ***F15B 15/20*** | (2006.01) |

(52) U.S. Cl.

CPC ..... *E02F 9/2285* (2013.01); *E02F 3/965* (2013.01); *E02F 9/2267* (2013.01); *F15B 15/149* (2013.01); *F15B 15/1428* (2013.01); *F15B 15/1447* (2013.01); *F15B 15/1457* (2013.01); *F15B 15/1466* (2013.01); *F15B 15/202* (2013.01); *F15B 15/204* (2013.01); *F15B 2211/7055* (2013.01)

(58) Field of Classification Search

CPC ..... E02F 3/965; E02F 9/2285; E02F 9/2267; F15B 15/204; F15B 15/202; F15B 15/1428; F15B 2211/7055

See application file for complete search history.

(56) References Cited

U.S. PATENT DOCUMENTS

2017/0191506 A1* 7/2017 Lacher ..... A01C 7/205

FOREIGN PATENT DOCUMENTS

| | | |
|---|---|---|
| EP | 0641618 A1 | 3/1995 |
| EP | 1580437 | 9/2005 |
| JP | 2009250252 A | 4/2009 |
| WO | 2013/052430 | 4/2013 |

* cited by examiner

*Primary Examiner* — Abiy Teka
*Assistant Examiner* — Daniel S Collins
(74) *Attorney, Agent, or Firm* — Roberts & Roberts, LLP

(57) ABSTRACT

The invention relates to a hydraulic cylinder, for example for use with a hydraulic tool, which hydraulic tool is provided with a frame and an element which is movable with respect to the frame by means of the hydraulic cylinder.

A hydraulic tool which is operated by means of a hydraulic cylinder as described above is known from, for example, European patent no. 0641618. This patent discloses a frame which is coupleable to a jib of an excavator or the like and to which an assembly of two jaws can be coupled. One of the jaws is pivotable with respect to the other jaw by means of a hydraulic adjusting cylinder (a double-acting piston/cylinder combination).

16 Claims, 12 Drawing Sheets

HYDRAULIC CYLINDER, FOR EXAMPLE FOR USE WITH A HYDRAULIC TOOL

The invention relates to a hydraulic cylinder, for example for use with a hydraulic tool, which hydraulic tool is provided with a frame and an element which is movable with respect to the frame by means of the hydraulic cylinder.

A hydraulic tool which is operated by means of a hydraulic cylinder as described above is known from, for example, European patent no. 0641618. This patent discloses a frame, which can be coupled to a jib of an excavator or the like and to which an assembly of two jaws can be coupled. One of the jaws is pivotable with respect to the other jaw by means of a hydraulic adjusting cylinder (a double-acting piston/cylinder combination).

During the outward stroke of the piston rod of the adjusting cylinder, the pivotable jaw is moved towards the other, fixed jaw, whereas, during the inward stroke of the piston rod, the pivotable jaw is moved away from the fixed jaw. To this end, such a hydraulic adjusting cylinder is made to be double-acting.

In general, large and expensive hydraulic adjusting cylinders with a valve hydraulics (often also referred to as a differential valve) are used in demolition devices, such as concrete crushers and scrap cutters etc. The valve hydraulics ensure that the piston (and piston rod) is pushed out quickly in an unloaded state by recycling the fluid (oil) used from the piston rod-side of the piston. This results in shorter cycle times. Only when the piston rod is loaded, does the differential valve switch in such a manner that the fluid on the piston rod-side can flow back freely to the hydraulic system of the demolition device (e.g. a hydraulics tank). The piston can then supply the maximum force.

On the one hand, a hydraulic tool, in particular demolition devices, such as concrete crushers and scrap cutters, should be usable in a sufficiently efficient manner in demolition work and should, on the other hand, also be manageable and manoeuvrable. There is therefore always some friction between, on the one hand, the performance of the hydraulic system and, on the other hand, the dimensions and the weight of the frame when developing a hydraulic tool. It is not always possible to use more sturdy, heavier and stronger hydraulic adjusting cylinders due to the limited installation space of the frame.

The invention therefore aims to provide an improved adjusting cylinder of the abovementioned preamble, which has an improved hydraulics system and is thus, on the one hand, characterized by higher closing forces, a greater or longer cylinder stroke and thus a greater cylinder volume and quicker cycle times and has, on the other hand, a more compact construction and a lower weight.

According to the invention, a hydraulic cylinder, for example for use with a hydraulic tool, is presented to this end, which hydraulic cylinder is provided with a frame and an element which is movable with respect to the frame by means of the hydraulic cylinder, and wherein the hydraulic cylinder at least comprises a supply for a pressurized fluid; one piston/cylinder combination consisting of a cylinder body provided with a first, closed end and a second, open end and a piston body accommodated in the cylinder body and provided with a piston rod extending from the second, open end of the cylinder body, wherein the cylinder body and the piston body delimit a first cylinder chamber and the cylinder body, the piston body and the piston rod delimit a second cylinder chamber, wherein the piston rod is hollow and is in fluid communication with the second cylinder chamber near the piston body, and the cylinder body comprises a cylinder rod which extends through the piston body from the first end and into the hollow piston rod and is provided with a cylinder piston body, wherein the cylinder piston body and the hollow piston rod delimit a third cylinder chamber, and wherein, in use, the piston body and the cylinder piston body perform alternately outward and inward working cycles on account of pressurized fluid supplied to the first, second and third cylinder chamber, respectively, via a first, second and third line, respectively, as well as at least a first control valve accommodated in a first valve block, which first control valve controls the supply of pressurized fluid via the first and second line to the first and second cylinder chamber, as well as at least one second control valve which is accommodated in a second valve block, which at least one second control valve controls the supply of pressurized fluid to the third cylinder chamber via the third line.

By making the piston rod hollow and accommodating an additional cylinder rod and cylinder piston body therein, a hydraulic adjusting cylinder is achieved with three cylinder chambers, which are controlled by two control valves which are designed as valve blocks. In this way, the hydraulic adjusting cylinder can be made more compact and lightweight, which results in quicker cycle times. In addition, this configuration is characterized by a longer cylinder stroke with higher closing forces and thus by a greater cylinder volume in combination with quicker cycle times.

The compact construction of the hydraulic adjusting cylinder is achieved in particular by the fact that the first valve block is fitted against and near the open end of the cylinder body. The compact construction is furthermore achieved by the fact that the first line from the first valve block is fitted next to the cylinder body and is connected to the first cylinder chamber near the closed end of the cylinder body. As a result of this arrangement, the delicate parts of the cylinder are also protected by the frame.

In addition, the second line is partly arranged in the first valve block and is connected to the second cylinder chamber near the open end of the cylinder body. This compactness also ensures a more efficient pumping around of fluid through the hydraulic system without unnecessary pressure loss, which results in quicker cycle times and higher closing forces.

According to another aspect of the hydraulic adjusting cylinder, the second valve block is fitted against the frame. The fact that the third line from the second valve block is also connected to the third cylinder chamber via the piston rod extending from the open end of the cylinder body not only results in to a more compact construction, but also to a more efficient pumping around of fluid through the hydraulic system without unnecessary pressure loss, with quicker cycle times and higher closing forces as a consequence thereof.

In order to make longer cylinder strokes possible, the first valve block is connected to the fluid supply by means of rotating fluid couplings.

Furthermore, the closed end of the cylinder body is coupleable to the movable element and the piston rod extending from the open end of the cylinder body is coupleable to the frame.

According to another example of a hydraulic adjusting cylinder according to the invention, the cylinder rod is provided with a first bore, which first bore is in fluid communication with the second cylinder chamber from the closed end of the cylinder chamber to near the cylinder piston body.

In this case, the cylinder rod is provided with a second bore, which second bore is in fluid communication with the third cylinder chamber from the closed end of the cylinder chamber and through the cylinder piston body. Due to this embodiment, a hydraulic adjusting cylinder can be made even more compact and thus even more lightweight. This embodiment is likewise characterized by quicker cycle times and a longer cylinder stroke with higher closing forces and more cylinder volume.

The compact installation is achieved in particular by the fact that the second valve block is fitted against the closed end of the cylinder body and by the fact that, in an additional embodiment, the first, second and third line, respectively, are partly arranged in the second valve block and connected to the first cylinder chamber, the first bore and the second bore, respectively.

In the abovementioned embodiment of a hydraulic adjusting cylinder, the closed end of the cylinder body is coupled to the frame and the piston rod extending from the open end of the cylinder body is coupled to the movable element.

For protection, the cylinder body may be provided with a protective sleeve.

More specifically, the first control valve comprises a pilot pressure valve which controls the opening of a clack valve in the first line, based on a fluid pressure in the second line. This prevents the occurrence of excessive pressures in the cylinder body, so that the risk of damage or even explosion of the cylinder is avoided.

More particularly, the pilot pressure valve is a pilot pressure valve with atmospheric relief, whereas, in an alternative embodiment, the pilot pressure valve cooperates with a pilot-operated non-return valve. This prevents the uncontrolled closing of the jaw due to leakage losses in lines.

The invention will now be explained in more detail by means of a drawing, in which.

For a better understanding of the invention, similar components will be denoted by the same reference numeral in the following description of the Figures.

Figure 1:
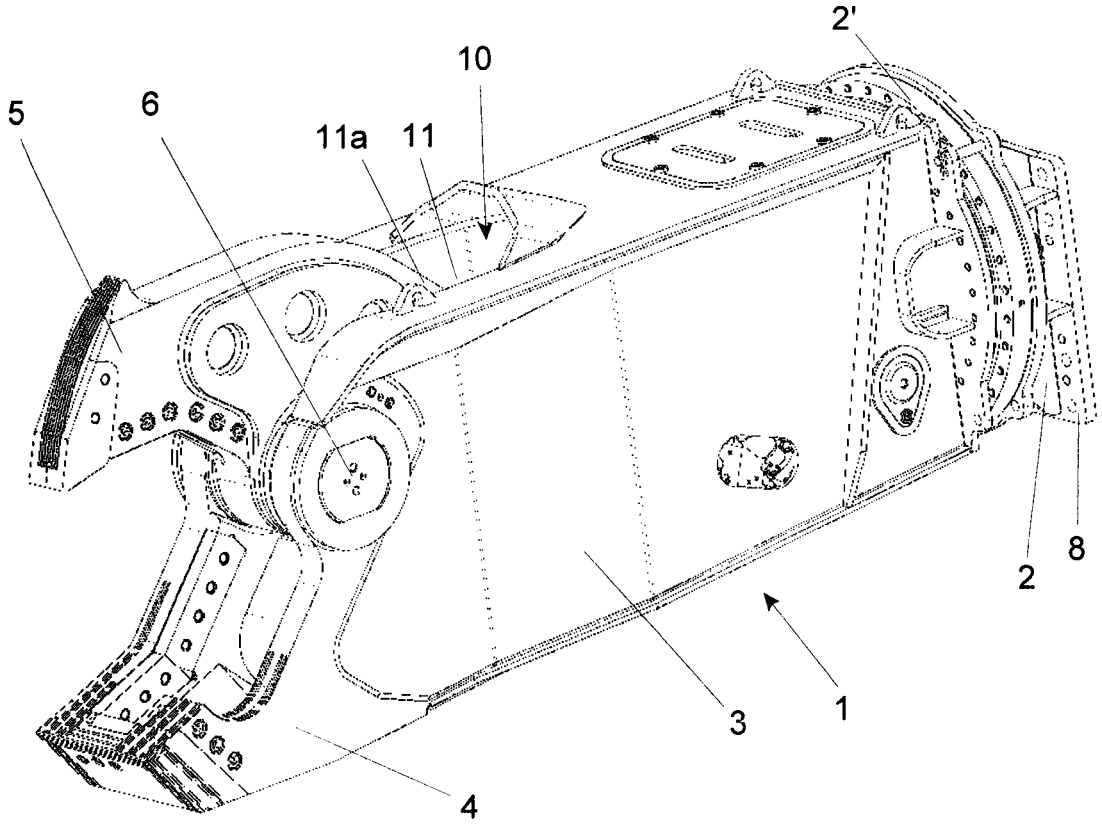
FIG. 1 shows an embodiment of a hydraulic tool according to the invention for coupling to the jib of an excavator.

FIG. 1 shows a general view of a hydraulic tool 1 which is driven or actuated by a hydraulic adjusting cylinder 10. The illustrated hydraulic tool 1 comprises a frame which comprises a first frame part 2, which first frame part 2 is coupled to a second frame part 3 by means of a turntable 2'. By means of the turntable 2', the two frame parts 2 and 3 are rotatable with respect to each other by means of means (not shown), for example hydraulically operable adjusting means which are known per se. The frame part 2 is furthermore provided with coupling means 8 which are known per se and with which the device 1 can be coupled to, for example, the end of an excavator arm of an excavator or a similar excavating tool.

The frame part 3 of the hydraulic tool 1 is provided with a first fixed jaw 4. In addition, the hydraulic tool 1 is provided with a second movable jaw 5, which is connected to the frame part 3 so as to be pivotable about a hinge pin 6. The second movable jaw 5 is pivotable with respect to the first fixed jaw 4 by means of an adjusting cylinder or piston/cylinder combination 10. In this embodiment of the piston/cylinder combination 10, the end 11*a* of a cylinder housing 11 is provided with a flange 11*z* with a flange or hinge loop 110 (see FIG. 2) and coupled to one end of the pivotable jaw 5 by means of a pin (not shown). The hydraulic adjusting cylinder 10 is accommodated in the frame part 3 with the piston rod 13 being rotatable about point 13*z* in order to make extension of the cylinder housing 11 possible. As FIG. 2 shows, the piston rod 13 extending from the cylinder body 11 is provided with a flange or hinge loop 13*z*, in which a hinge pin (not shown) can be accommodated for a hinged coupling to the frame part 3.

Figure 2:
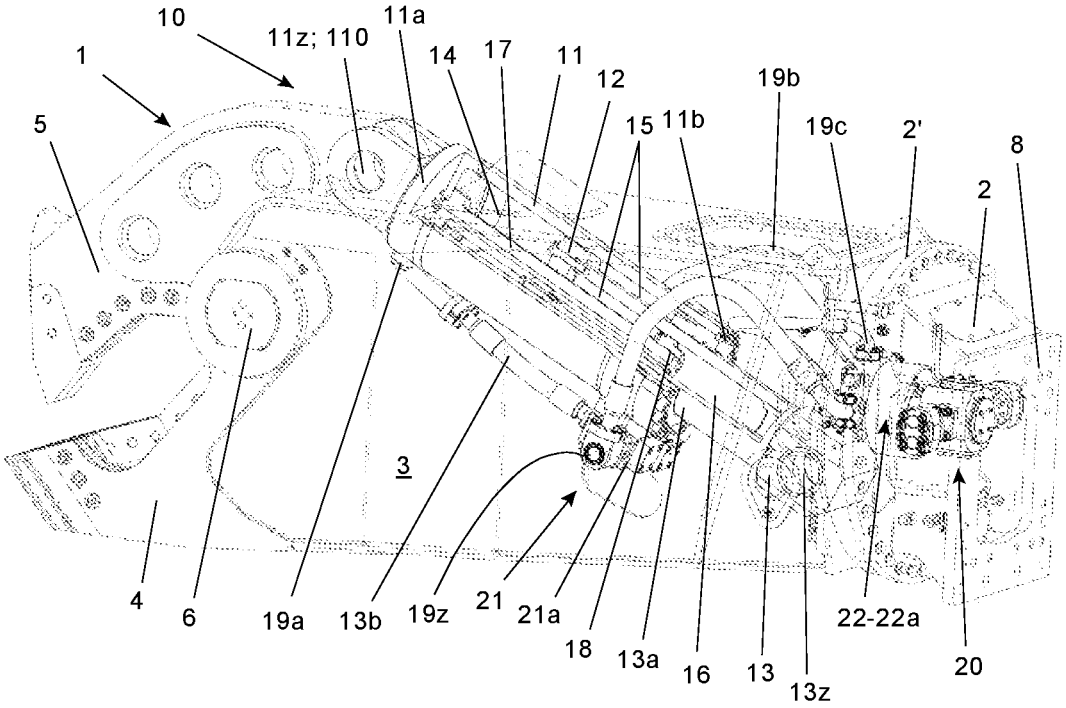
FIGS. 2 and 3 show a first embodiment of a hydraulic cylinder according to the invention.

More specifically, FIG. 2 shows the hydraulic tool provided with a first embodiment of a hydraulic cylinder according to the invention. The hydraulic cylinder 10 is in the operating state in which the cylinder housing 11 and the piston rod 12 are extended halfway (outward stroke=closed jaws 4 and 5). During the outward stroke of the hydraulic cylinder 10, the pivotable jaw 5 is moved against the fixed jaw 4. With such a hydraulic tool, it is possible to perform demolition, breaking or cutting operations, in which large cylinder forces can be transmitted to the jaws 4 and 5.

Such hydraulic tools, for example configured as demolition devices, such as concrete crushers and scrap cutters etc., are operated on account of the displacement of a pressurized medium, often oil. The hydraulic adjusting cylinder 10 is in this case provided with a control valve for passing a medium or fluid (oil) which is accommodated in a hydraulics reservoir (sump) to and from the piston/cylinder combination 10 and which is circulated in the hydraulic system by means of a hydraulic pump unit of the scrapping device.

The hydraulic cylinder 10 is provided with supply means 20 for supplying and removing a pressurized fluid in a hydraulic system composed of several clack valves and lines. Furthermore, the hydraulic cylinder 10 is provided with at least one piston/cylinder combination consisting of a cylinder body 10 provided with a first, closed end 11*a* and a second, open end 11*b* and a piston body 12 which is accommodated in the cylinder body 11 and is provided with a piston rod 13 extending from the second, open end 11*b* of the cylinder body 11. The piston body 12 lies sealingly against the inner periphery of the hollow cylinder 11, and thus the cylinder body 11 and the piston body 12 (in particular the side facing the closed cylinder end 11*a* thereof) delimit a first cylinder chamber 14, and the cylinder body 11, the piston body 12 (in particular the side facing the open cylinder end 11*b* thereof) and the piston rod 13 delimit a second cylinder chamber 15.

It should be noted that in this specific embodiment of the hydraulic tool, the hydraulic cylinder used therein is coupled by its first, closed cylinder end 11*a* to an end of the pivotable jaw 5 by means of a pin (not shown) which is accommodable in a hinge opening (or loop) 110 of a flange 11*z* of the closed cylinder end 11*a*.

Figure 3:
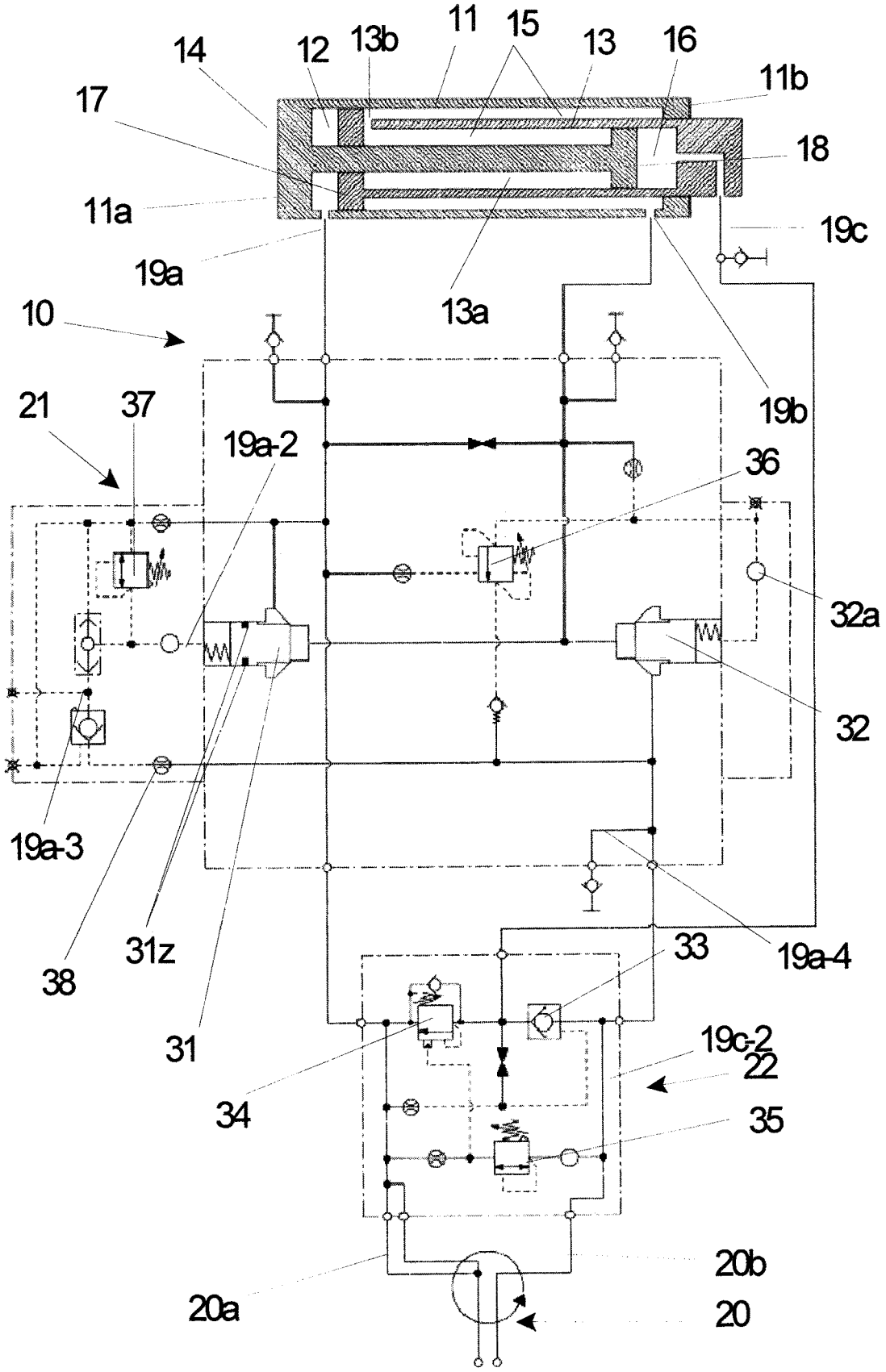

In the first embodiment as shown in FIGS. 2 and 3, the piston rod 13 is hollow and therefore provided with a first bore 13*a*. The cylinder body 11 is also provided with a cylinder rod 17 which extends from the first closed cylinder end 11*a* through the piston body 12 and into the first bore 13*a* of the hollow piston rod 13. At its free end, which extends into the hollow piston rod 13, the cylinder rod 17 is provided with a cylinder piston body 18 which bears sealingly against the inner periphery of the hollow piston rod 13.

The side of the cylinder piston body 18 facing the open cylinder end 11*b* and the hollow piston rod 13 delimit a third cylinder chamber 15.

Near the piston body 12 which forms part of the piston rod 13, the first bore 13*a* of the hollow piston rod 13 is in fluid communication with the second cylinder chamber 15. This fluid communication is denoted in the figures by reference numeral 13*b* and may consist of one or several openings which end in the hollow space 13*a* of the piston rod 13. In this embodiment, the fluid communication openings 13*b* are provided very close to the piston body 12, so that the space which is delimited by the side facing the closed cylinder end 11*a* of the cylinder piston body 18 and the hollow piston rod 13 and the piston body 12 forms part of the second cylinder chamber 15.

The first cylinder chamber 14, the second cylinder chamber 15 and the third cylinder chamber 16 are connected to the supply means 20 by means of separate first 19*a*, second 19*b* and third 19*c* fluid lines, respectively, via valve hydraulics. In use, the piston body 12 and the cylinder piston body 18 can perform alternate outward and inward working cycles, respectively, on account of pressurized fluid which is passed through the first 19*a*, second 19*b* and third 19*c* line, respectively, to the first 14, second 15 and third 16 cylinder chamber, respectively, and on the basis thereof, it is possible to move the pivotable jaw 5 to and from the fixed jaw 4.

The valve hydraulics comprises at least a first control valve 21 which is accommodated in a first valve block 21*a*, which first control valve 21 controls the supply of pressurized fluid via the first and second line 19*a*-19*b* to the first and the second cylinder chamber 14 and 15, respectively. In addition, the valve hydraulics include at least one second control valve 22 in a second valve block 22*a*. The at least one second control valve 22 controls the supply of pressurized fluid via the third line 19*c* to the third cylinder chamber 16.

By structuring the piston rod 13 hollow and accommodating an additional cylinder rod 17 and cylinder piston body 18 therein, a compact hydraulic adjusting cylinder is achieved comprising three cylinder chambers 14-15-16 which are actuated by two control valves 21-22 which are configured as valve blocks. In this way, the hydraulic adjusting cylinder can be made more compact and lightweight, which results in quicker cycle times. In addition, this configuration is characterized by a longer cylinder stroke with higher closing forces.

As is shown in FIG. 2, the first valve block 21*a* is fitted against and near the open end 11*b* of the cylinder body 11. This results in a compact construction of the hydraulic adjusting cylinder, which compactness is improved further by the fact that the first line 19*a* from the first valve block 21*a* is fitted along the cylinder body 11 and is connected to the first cylinder chamber 14 near the closed end 11*a* of the cylinder body 11.

As FIG. 2 shows, the second line 19*b* is partly arranged in the first valve block 21*a* and this second line 19*b* passes through the cylinder body 11 as a bore near the open end 11*b* of the cylinder body 11 and is in this case connected to the second cylinder chamber 15.

In this embodiment of the hydraulic cylinder 10, the second valve block 22*a* is furthermore fitted against the frame and in particular against the turntable 2'. In this case, the third line 19*c* is connected to the third cylinder chamber 16 from the second valve block 22*a* via the piston rod 13 extending from the open end 11*b* of the cylinder body 11. More specifically, the first valve block 21*a* is connected to the fluid supply 19*a* and 19*b* by means of rotating fluid couplings 19*z*. As a result hereof, the fluid couplings 19*z* are able to move concomitantly with the pulling in and pulling out of the hydraulic cylinder 10, as a result of which the construction can, on the one hand, be made more compact, because fluid lines 19*a* and 19*b* which would otherwise require more space in the frame 3 are no longer necessary. On the other hand, it is possible in this way to absorb the rotating movements of the cylinder 10 with respect to the frame 3, which increases the operational life of the lines and the couplings 19*z*.

In this first embodiment of the hydraulic cylinder 10, the closed end 11*a* of the cylinder body 11 is coupled to the movable element 5 (the pivotable jaw 5) and the piston rod 13 extending from the open end 11*b* of the cylinder body 11 is coupled to the frame 3, near or with the turntable 2', as is clearly shown in FIGS. 2 and 3. Another embodiment of the hydraulic cylinder is shown in FIGS. 4 and 5.

Figure 4:
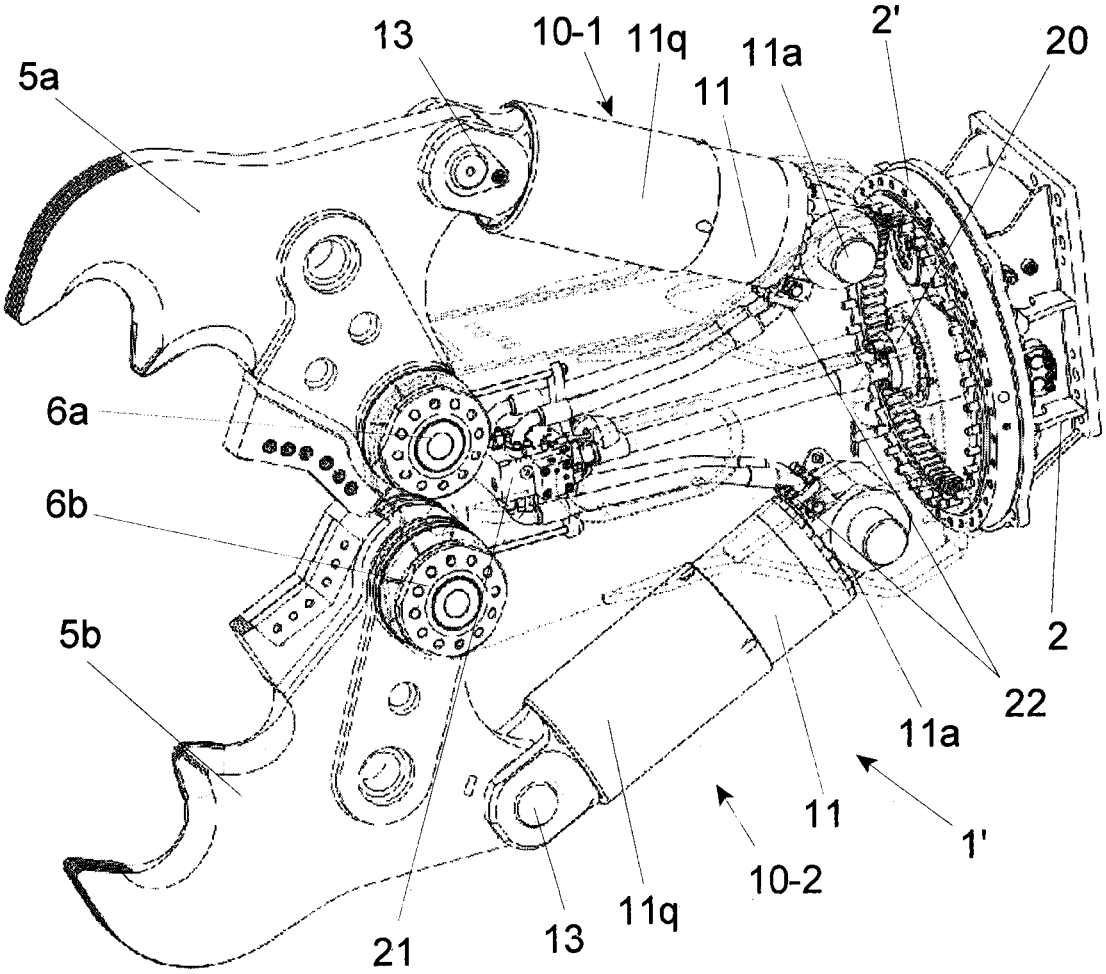
FIG. 4 shows a second embodiment of a hydraulic tool according to the invention for coupling to the jib of an excavator.
Figure 5:
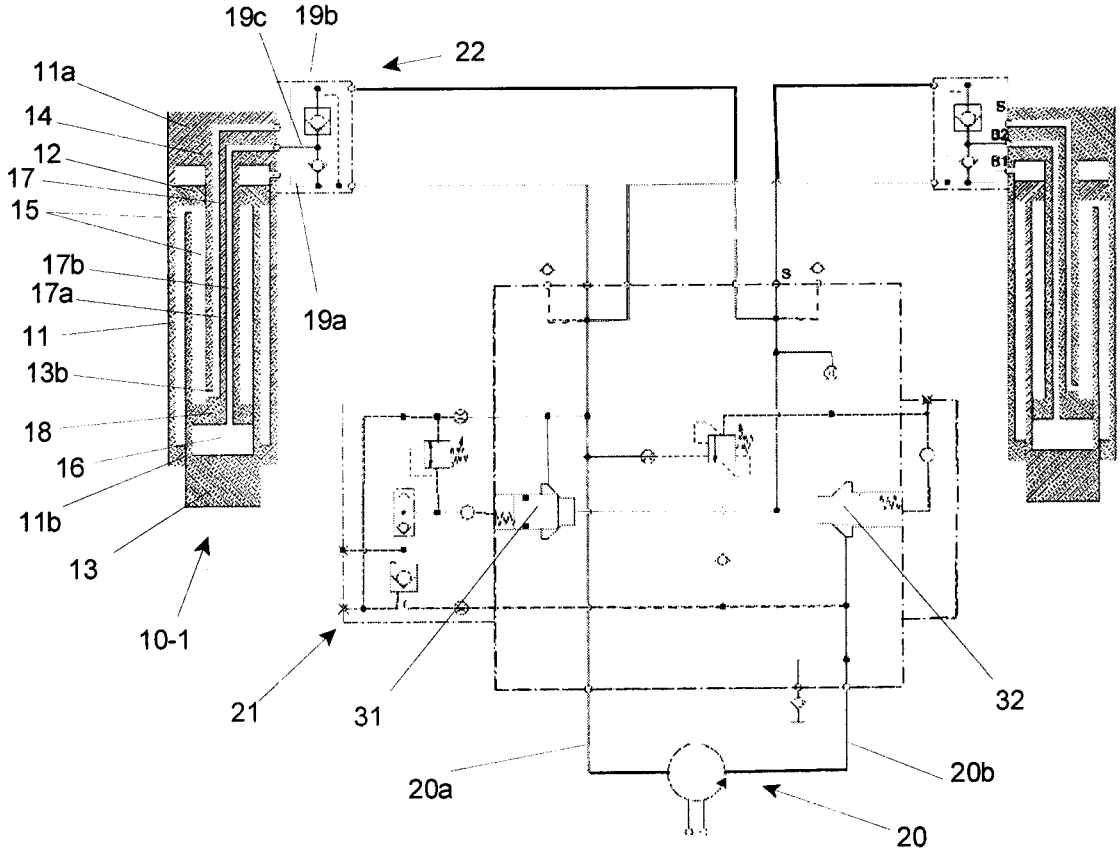
FIG. 5 shows a second embodiment of a hydraulic cylinder according to the invention.

In these FIGS. 4 and 5, the hydraulic cylinder is deployed in another embodiment of the hydraulic tool which is denoted by reference numeral 1'. In this embodiment, the hydraulic tool 1' is configured as a cutter tool, provided with two pivotable jaws 5*a*-5*b* which are coupled to the frame 3 so as to be pivotable about hinge pins 6*a* and 6*b*. Each pivotable jaw 5*a* and 5*b* is actuable by means of a hydraulic cylinder 10 which is now provided with two piston/cylinder combinations 10-1 and 10-2, rather than one.

The hydraulic cylinder 10 in FIG. 4 is in the operating state, in which the cylinder housings 11 and the piston rods 12 of both piston/cylinder combinations 10-1 and 10-2 are completely pulled in (inward stroke=open jaws 5*a* and 5*b*).

In this embodiment, the closed end 11*a* of the cylinder body 11 of every hydraulic cylinder 10-1 and 10-2 is coupled to the frame 3 (the table 2') and the piston rods 13 extending from the open end 11*b* of the cylinder body 11 are hingeably coupled to each pivotable jaw 5*a* resp. 5*b*.

For protection, every cylinder body 11 is provided with a protective sleeve or protective bush 11*q* which protects the cylinder body 11 and optionally also the delicate cylinder component. Referring to the first embodiment shown in FIGS. 1 and 2, due to the specific arrangement of the cylinder body 11 in this embodiment, the delicate cylinder components, including the retractable and extendable piston rod 13, the various lines 19*a*-19*c* and the control valves 21-22 are protected by the robust construction of the frame 3.

In the arrangement from FIGS. 4 and 5 comprising two piston/cylinder combinations 10-1 and 10-2, a protection of the frame is not, or hardly, possible. As a result thereof, each piston/cylinder combination 10-1 and 10-2 is accommodated in the frame in a reversed manner and each cylinder body 11 is provided with a protective sleeve 11*q*. In addition, the connections for the hydraulic system are moved to a less vulnerable position in the frame of the hydraulic tool.

A less vulnerable position relates to the closed end 11*a* of the cylinder body 11 of each hydraulic cylinder 10-1 and 10-2, respectively, against which each second control valve 22 is fitted. In addition, the first, second and third line 19*a*-19*b*-19*c*, respectively, are partly arranged in every second control valve 22 (valve block 22*a*) and are in this case directly connected to the first cylinder chamber 14 or the first bore 17*a* or the second bore 17*b*, respectively, in the cylinder rod 17.

Yet another less vulnerable position relates to the location where the first control valve 21 is fitted, i.e. installed between the two cylinders 11 and at the location of the hinge pins 6*a* and 6*b* on the frame 3.

As is shown in FIG. 5, in this embodiment, the cylinder rod 17 is provided with a first bore 17*a*, which first bore 17*a* is in fluid communication with the second cylinder chamber 15 from the closed end 11*a* of the cylinder chamber 11 to near the cylinder piston body 18. In addition, the cylinder rod 17 is provided with a second bore 17*b*, which second bore 17*b* is in fluid communication with the third cylinder chamber 16 from the closed end 11*a* of the cylinder chamber 11 and through the cylinder piston body 18.

By making the piston rod 13 hollow in this embodiment as well and accommodating an additional cylinder rod 17 and cylinder piston body 18 therein, a compact hydraulic adjusting cylinder with three cylinder chambers 14-15-16 is achieved which are controlled by the two control valves 21-22 configured as valve blocks. Providing two hydraulic adjusting cylinders (reference numerals 10-2 and 10-2) not only results in a more compact and lightweight construction, leading to quicker cycle times, but this double embodiment can also be used efficiently to drive a demolition cutter having two pivotable jaws 5*a*-5*b* with higher closing forces.

Analogously to the first embodiment, the valve hydraulics comprises at least a first control valve 21 which is accommodated in a first valve block 21*a*, which first control valve 21 controls the supply of pressurized fluid via the first and second line 19*a*-19*b* to the first and the second cylinder chamber 14 and 15, respectively, of both hydraulic adjusting cylinders 10-1 and 10-2. In addition, the valve hydraulics comprises two second control valves 22, one for each of the hydraulic adjusting cylinders 10-1 and 10-2. Every control valve 22 is provided in a second valve block 22*a* and every second control valve 22 controls the supply of pressurized fluid to the third cylinder chamber 16 of the respective hydraulic cylinder 10-1 and 10-2, respectively, via the third line 19*c*.

The compact construction is furthermore achieved by the fact that each second valve block 22*a* is fitted against the closed end 11*a* of the cylinder body 11 of the respective hydraulic cylinder 10-1 and 10-2, respectively. In this embodiment, the first, second and third line 19*a*-19*b*-19*c*, respectively, are partly arranged in every second valve block 22*a* and are in this case connected to the first cylinder chamber 14, or the first bore 17*a* and the second bore 17*b*, respectively, in the cylinder rod 17.

FIGS. 6 to 12 show different configurations of operating states of a hydraulic cylinder according to the first embodiment according to the invention, as is shown in FIG. 3. It should be noted that the illustrated valve hydraulics can also be used in the second embodiment, as shown in FIGS. 4 and 5.

The reference numerals 20*a* and 20*b* denote the central supply and relief line for the pressurized fluid via which the supply means 20 pass the pressurized fluid through the valve hydraulics and to the various cylinder chambers 14-15-16.

It should be noted for all FIGS. 6 to 12 that the first control valve 21 which is included in the first valve block 21*a* is composed of two clack valves 31 and 32, which control the main flow of pressurized fluid via the first and second line 19*a*-19*b* from and to the first and second cylinder chamber 14 and 15. In addition, pilot valves are incorporated in the control valve 21 for controlling the clack valves 31 and 32. Control valve 21 controls the speed/power mode of the hydraulic tool during closing of the movable jaw 5 (in the first embodiment from FIGS. 1-3) or the movable jaws 5*a*-5*b* (in the second embodiment from FIGS. 4 and 5). In addition, the control valve 21 has an automatic pressure safeguard in case the return flow of fluid from the cylinder chambers is blocked.

The second control valve 22 is incorporated in the second valve block 22*a* and controls the fluid flow via the third line 19*c* to and from the third cylinder chamber 16. To this end, the second control valve 22 is provided with two clack valves, being a third and fourth clack valve 33 and 34, respectively. The fourth clack valve 34 is controlled by the pilot valve 35. The second control valve 22 may be switched in the so-called speed or power mode when opening the jaw, by means of pilot control of the fourth clack valve 34 by means of the pilot valve 35. This embodiment may be used with specific applications of a hydraulic tool, which require a higher opening power of the jaw, such as for example with a scrap cutter.

Each first and second clack valve 31 and 32 has a valve housing with a valve body and are configured such that the valve bodies of both clack valves 31 and 32 can assume two positions in the valve housing. A first, closed position and a second, open position. As is clearly shown in the basic configuration from FIG. 3, which also applies to the various configurations in FIGS. 6-12, the valve body of the first clack valve 31 is provided with a seal 31*z*. For the sake of clarity, this seal 31*z* is not shown in FIGS. 6-12, but is nevertheless present.

The central supply line 20*a* is routinely connected to the first line 19*a* to the first cylinder chamber 14 and this connection can therefore be opened or closed by the first clack valve 31.

Figure 6:
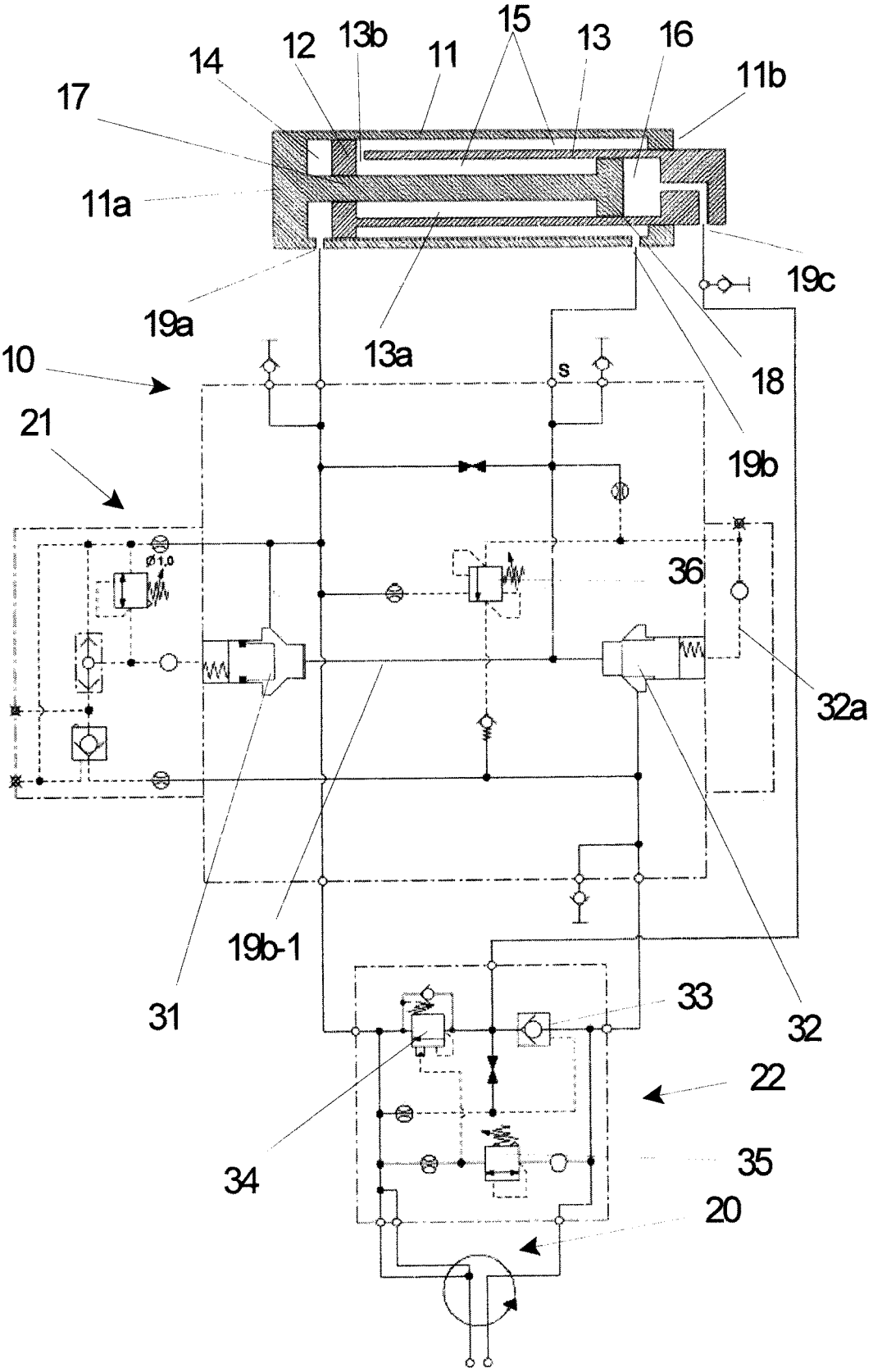
FIGS. 6-12 show configurations of operating states of a hydraulic cylinder according to a first embodiment according to the invention.

FIG. 6 shows the configuration of the valve hydraulics in the so-called speed mode during closing of the jaw of the hydraulic tool, wherein the hydraulic adjusting cylinder 10 is extended at high speed (and little force). In this case, the piston rod 13 moves to the right in the plane of FIG. 6 (as indicated by the arrow), or the cylinder housing 11 moves to the left. To this end, pressurized fluid/oil is passed to the first cylinder chamber 14 via the first supply line 20*a* and the first fluid line 19*a*, and pressurized medium (oil) also flows via the first supply line 20*a* and the fourth clack valve 34 into the third cylinder chamber 16 via the third fluid line 19*c*. In this case, the third clack valve 33 is closed.

The fluid (oil) in the second cylinder chamber 15 is displaced from the cylinder chamber 15 and flows to the first control valve 21 via the second fluid line 19*b*. At that moment, the second clack valve 32 of the first control valve 21 is closed by the pilot pressure in part line 32*a* and the first clack valve 31 is opened by the fluid pressure in the second fluid line 19*b* (in particular in part line 19*b*-2). As a result thereof, the oil flow from the second fluid line 19*b* is recycled with the fluid flow in the first fluid line 19*a*. At that moment, there is no return flow of fluid in the return line 20*b* back to the fluid reservoir/tank and only tank pressure prevails in return line 20*b*.

Figure 7:
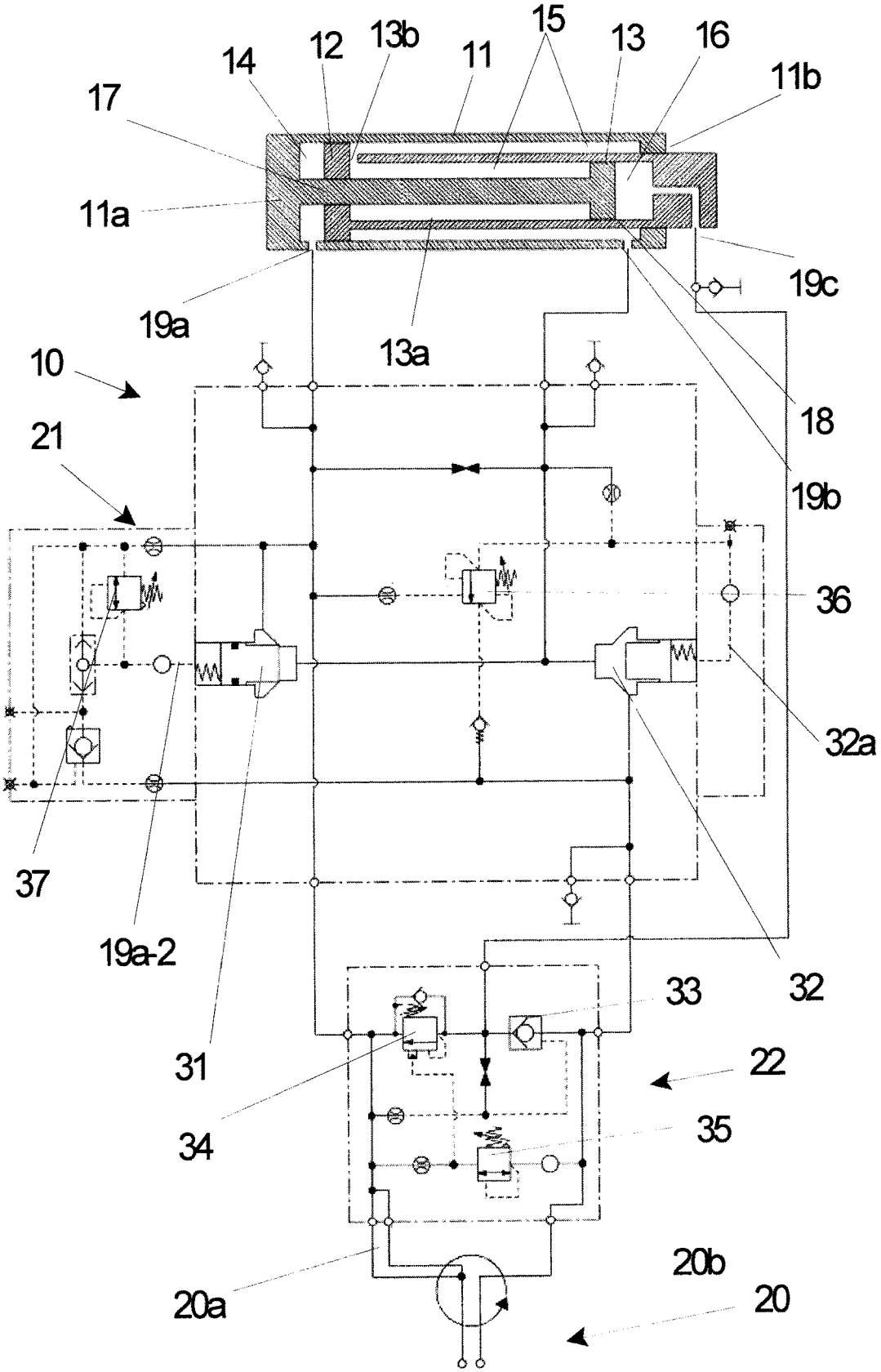

FIG. 7 shows the configuration in the so-called force mode (power position) when closing the jaw of the hydraulic tool. At a certain pressure (for example 160 bar), a pilot pressure valve 36 opens and thus reduces the pilot pressure in pilot or part line 32*a* on the second clack valve 32. The second clack valve 32 opens, as a result of which the pressurized stream in line 19*b* can suddenly flow away, via return line 20*b* (since a lower tank pressure prevails in the return line 20*b*). In this case, the first clack valve 31 under pilot pressure in the part line 19*a*-2 is closed and maximum operating pressure is exerted on first and third cylinder chambers 14 and 16. The second cylinder chamber 15 is relieved entirely via the second fluid line 19*b*, the second clack valve 32 and the return line 20*b* into the fluid reservoir/tank. Then, the closing force of the jaw is at its peak.

Figure 8:
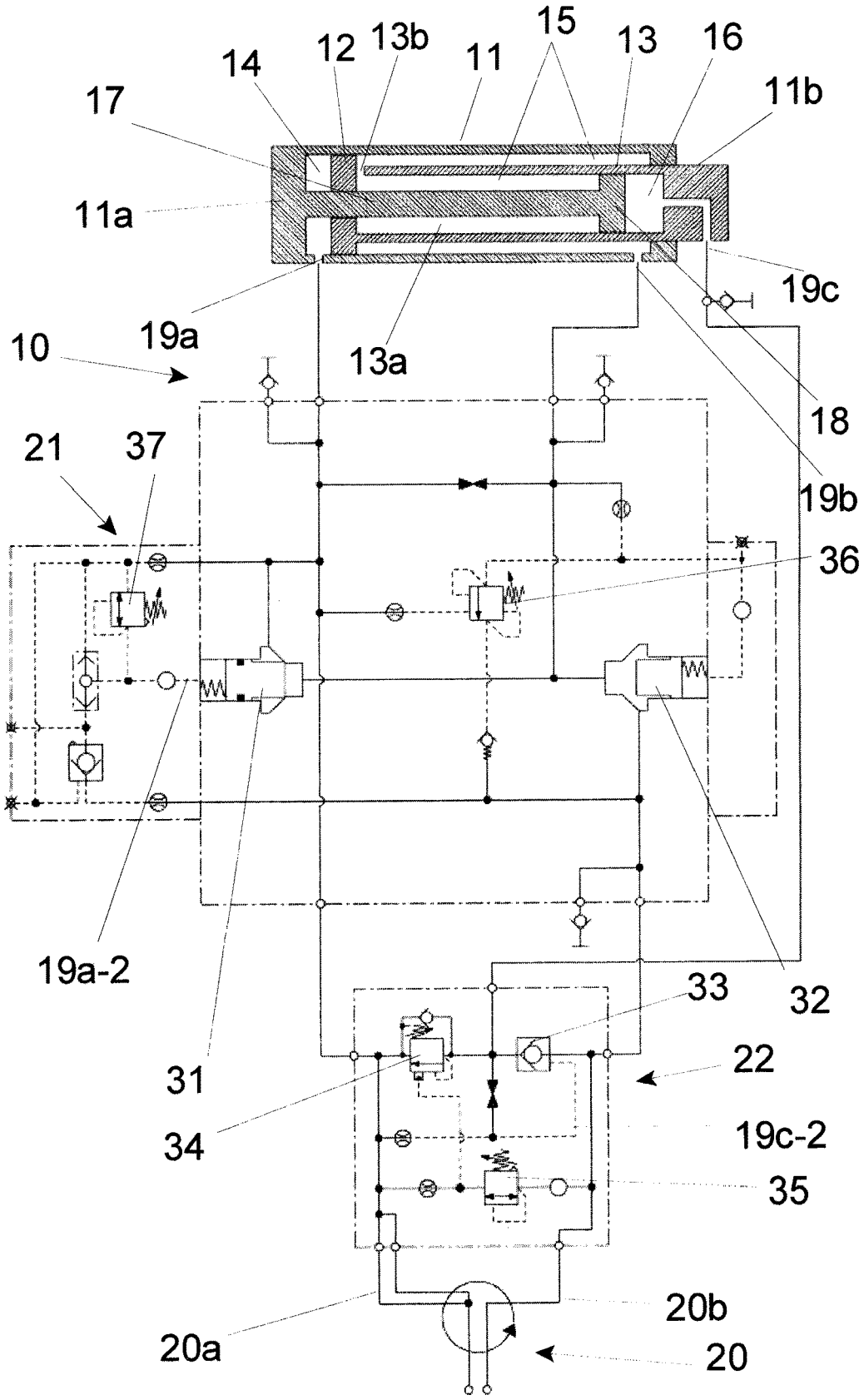

FIG. 8 shows the configuration in the so-called speed mode during opening of the jaw, in which the hydraulic adjusting cylinder 10 is retracted at high speed. In this case, the piston rod 13 moves to the left in the plane of FIG. 6 (as is indicated by the arrow), or the cylinder housing 11 moves to the right. In this case, pressurized fluid (oil) is supplied in the return line 20*b* and via the second clack valve 32, which is forced open by the fluid flow on the right in the figure, fluid flows into the second cylinder chamber 15 via the second fluid line 19*b*. The piston rod 13 moves to the left in the cylinder housing 11. The first clack valve 31 is kept closed by pilot pressure from the pilot pressure valve 37 dispensed in the part line 19*a*-2, so that no pressure loss occurs in the return line 20*b* and the second fluid line 19*b*.

Fluid (oil) which is displaced from the first cylinder chamber 14 which is becoming smaller flows back in an unpressurized manner via the first fluid line 19*a* past the open first clack valve 31 and via the supply line 20*a* back to the fluid reservoir/tank. Fluid from the third cylinder chamber 16 is also displaced, but this flows to the second control valve 22 via the third fluid line 19*c*. At that moment, the fourth clack valve 34 is closed and the third clack valve 33 opens as a result of displacement via part line 19*c*-2. In this way, the fluid flow from the third cylinder chamber 16 recycles itself via the third fluid line 19*c*, the part line 19*c*-2 and past the third clack valve 33 with the fluid flow in return line 20*b* in the direction of the second fluid line 19*b*/second cylinder chamber 15.

Figure 9:
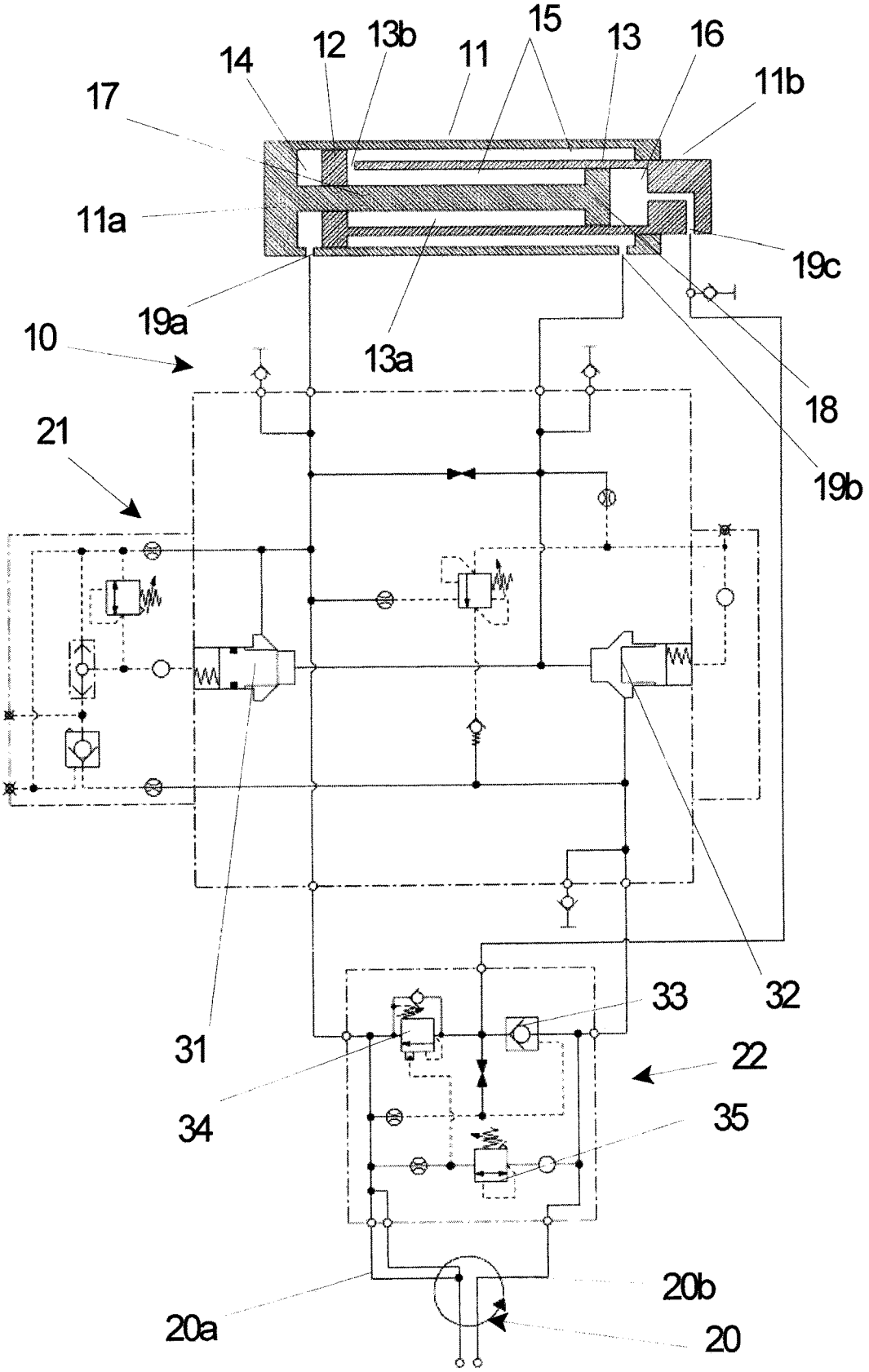

FIG. 9 shows the configuration in the so-called force mode during opening of the jaw 5. If the jaw 5 experiences resistance during opening, for example because scrap metal and/or demolition material have become stuck between the jaws 4 and 5, then it is desirable for the opening force of the jaw 5 to be increased temporarily. This may be achieved by opening the fourth clack valve 34 at that moment by means of pilot valve 35. This allows the fluid pressure in the third cylinder chamber 16 and the third fluid line 19*c* to be relieved in an unpressurized manner to the fluid reservoir/tank via the fourth clack valve 34 and the supply line 20*a*. At that moment, the third clack valve 33 is closed. The pressure in the second cylinder chamber 15 is now at its peak and the first and third cylinder chambers 14 and 16 have been relieved to the fluid reservoir/tank. The opening force of the jaw 5 is now at its maximum.

It should be noted that this configuration position shown in FIG. 9 is not required for every use. If it is not required, then the embodiment of the second control valve 22 can be simplified by omitting a pilot valve 35 and the fourth clack valve 34 can simply be configured as a non-return valve.

Figure 10:
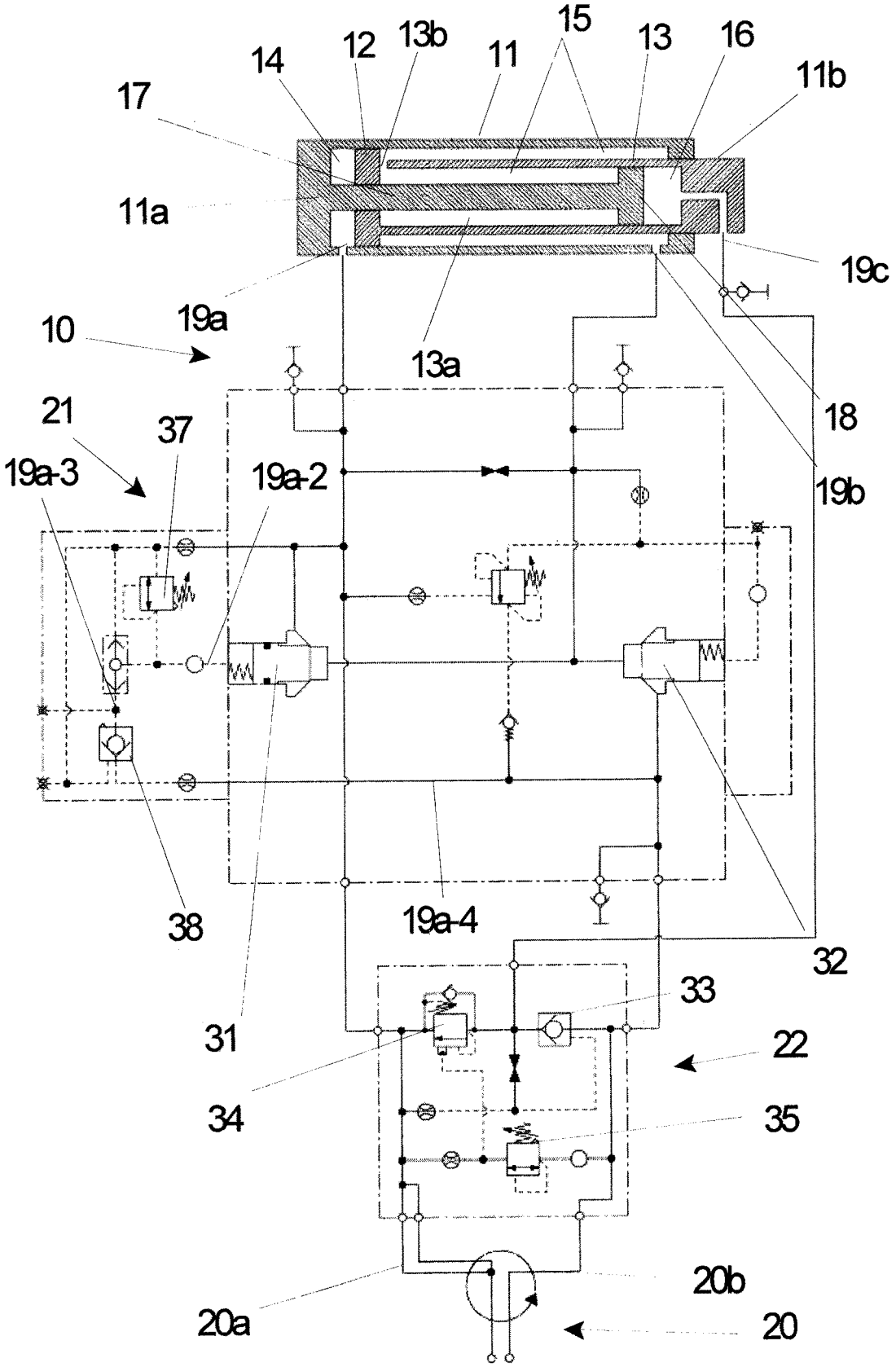

FIG. 10 shows the configuration at rest when the jaw 5 is open and before the jaw is closed. In this case, the first clack valve 31 is kept closed, because the pilot pressure in the part line 19*a*-2 is captured between the pilot pressure valve 37 of the first clack valve 31 and a pilot-operated non-return valve 38 in the pilot control line 19*a*-3. Because the first clack valve 31 is kept closed, the top jaw 5 (of the jaws of a demolition cutter) cannot close in an uncontrolled manner due to leakage losses in lines. The moment fluid pressure is actively applied to the supply line 20*a* and the first fluid line 19*a* in order to close the jaw 5, the pilot-operated non-return valve is opened and the pilot pressure of the first clack valve 31 is relieved via the relief line 19*a*-4. The jaw 5 is then closed and the cycle from FIG. 6 will be repeated.

Figure 11:
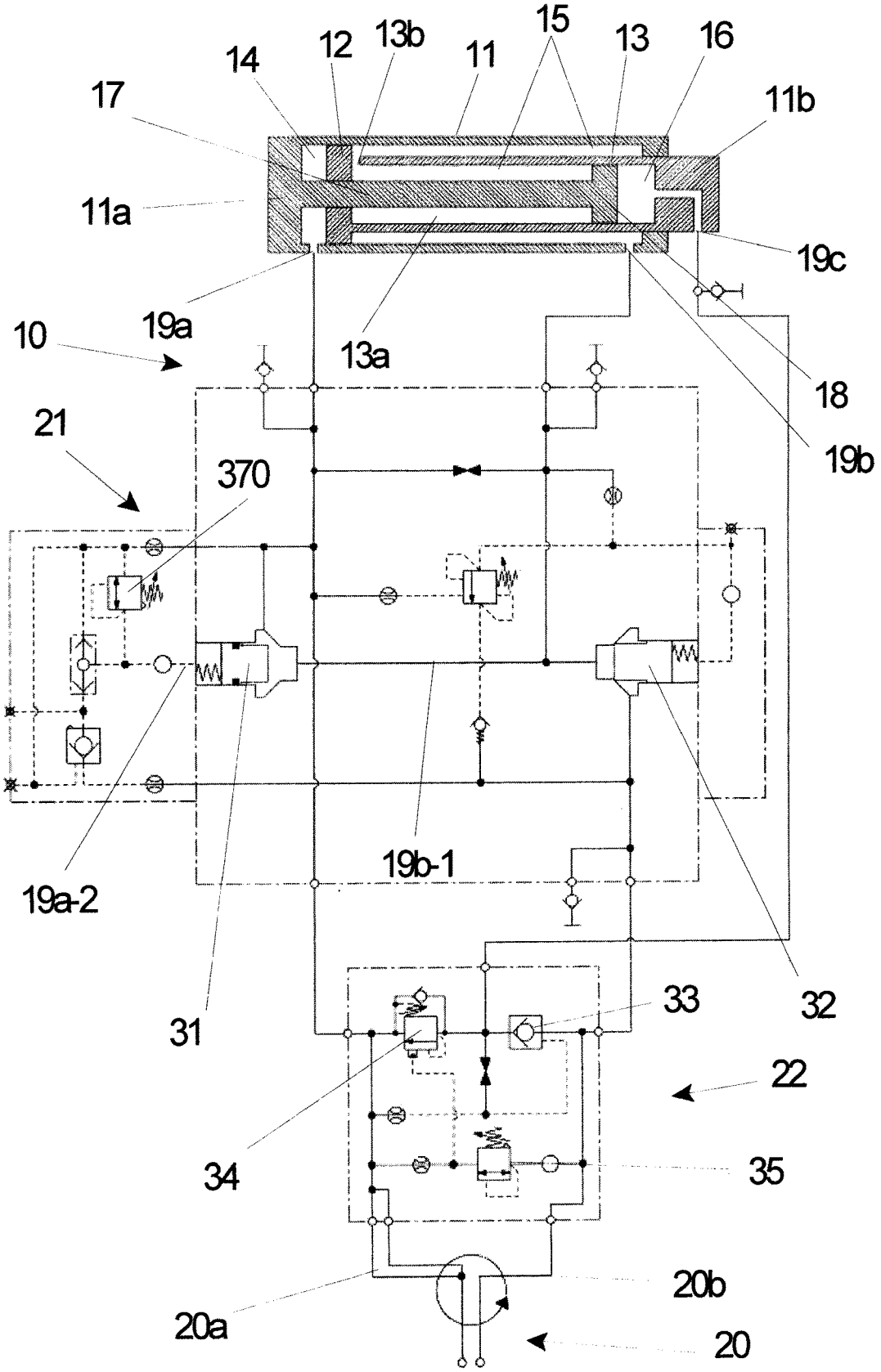

FIG. 11 shows the configuration in case the return line 20*b* is blocked as a result of a defect (for example in case of a broken hose coupling) and the full fluid operating pressure acts on the supply line 20*a*. Normally, all valves could be blocked due to the fact that the various pilot control means can no longer be relieved. This leads to the fluid flow of the second cylinder chamber 15 being blocked and, due to the high pilot ratio of these cylinders (ratio of surface rod side versus bottom side), the pressure in the second cylinder chamber 15 becomes dangerously high, which may cause the cylinder housing 11 to become damaged or even explode. By means of a pilot pressure valve 37 with atmospheric relief (operation is independent of the return pressure), the pilot pressure in the part line 19*a*-2 on the first clack valve 31 is maximized to, for example, 380 bar. If the fluid pressure in return line 19*b* becomes higher than 380 bar, this higher pressure via the part line 19*b*-1 will act against the pilot pressure in the part line 19*a*-2 on the first clack valve 31 and eventually open the latter. As a result thereof, the pressure in the cylinder housing 11 between bottom side and rod side of the piston body 12 is equalized, and this prevents the cylinder 11 from exploding.

Figure 12:
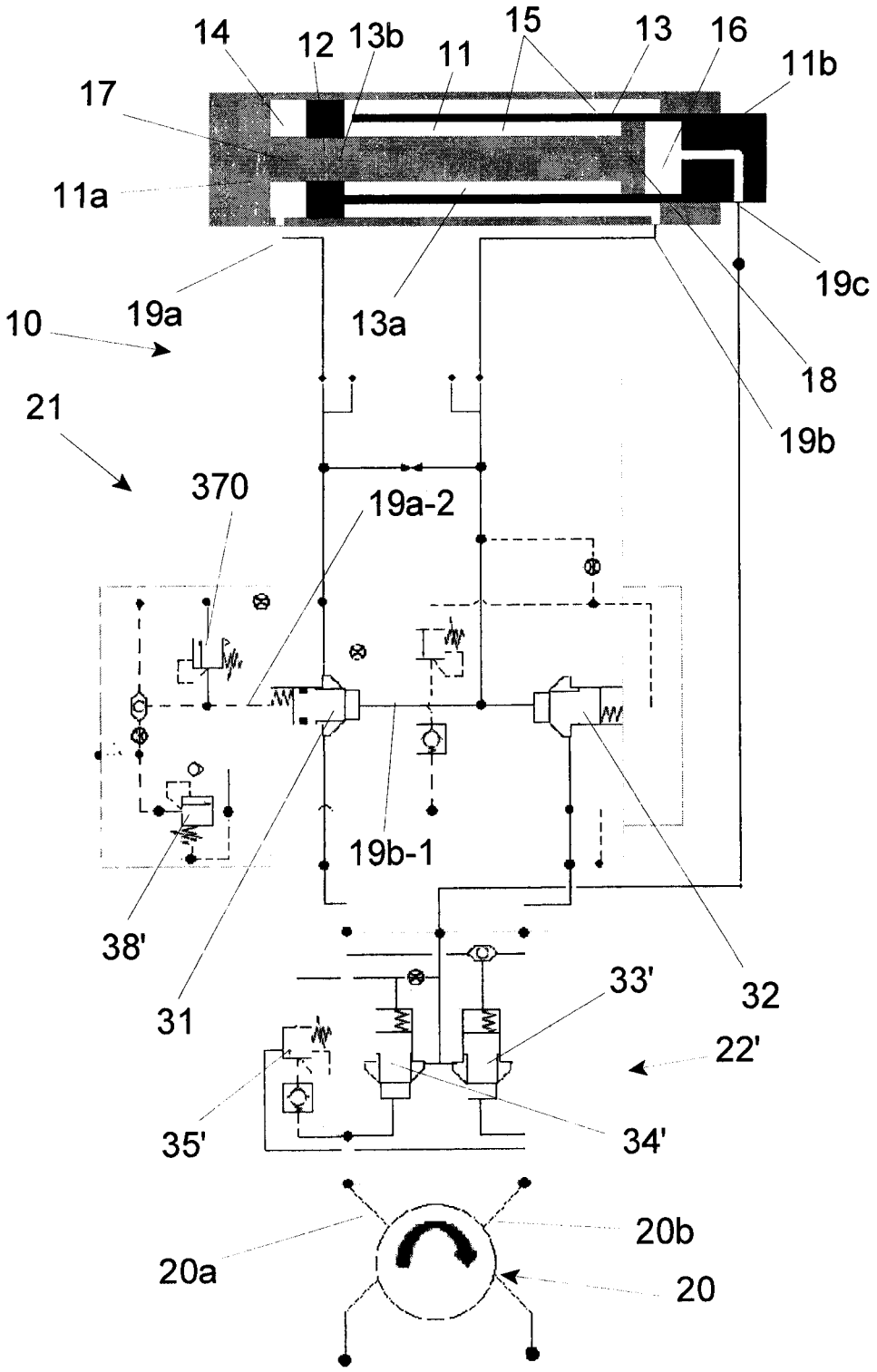

FIG. 12 shows the configuration of the hydraulic adjusting cylinder 10 in the configuration state of FIG. 10, in which the pilot-operated non-return valve 38 has been replaced by a biasing valve 38". With this configuration, a lower bias can be applied to the first clack valve 31. This lower pretension is sufficiently great to prevent the movable jaw 5 from closing in an uncontrolled manner. In addition, the switching behaviour of the first clack valve 31 is smoother. Furthermore, FIG. 12 shows an alternative second pilot valve, designated 22', where third clack valve 33, fourth clack valve 34 and pilot valve 35 for the fourth clack valve have been replaced by logic elements and are designated with reference numerals 33', 34' and 35'. This embodiment with the logic elements 33', 34' and 35' is suitable for processing and passing larger oil flows to the hydraulic adjustment cylinder 10, so that it can also be used with larger-sized demolition devices, such as large concrete crushers and larger scrap shears.

LIST OF REFERENCE NUMERALS

1-1' hydraulic tool (first and second embodiment)
2 first frame part 2
2' turntable
3 second frame part
4 fixed jaw
5 element movable with respect to the frame (movable jaw)
6 hinge pin
8 coupling means
10-10-1/10-2 hydraulic piston/cylinder combination
11 cylinder body
11*a* first, closed end of cylinder body
11*b* second, open end of cylinder body
12 piston body accommodated in the cylinder body
13 piston rod
13*a* bore in piston rod
13*b* connection between first bore and second cylinder chamber
13*z* flange or hinge loop
14 first cylinder chamber
15 second cylinder chamber
16 third cylinder chamber
17 cylinder rod
17*a* first bore in cylinder rod
17*b* second bore in cylinder rod
18 cylinder piston body
19*a* first fluid line
19*a*-2 pilot line
19*a*-3 pilot control line

19*a*-4 relief line
19*b* second fluid line
19*b*-1 pilot or part line
19*c* third fluid line
19*c*-2 part line for third clack valve
20 supply means for a pressurized fluid
20*a* supply line
20*b* return line
21 first control valve
21*a* first valve block
22-22' second control valve (first and second embodiment)
22*a* second valve block
20*b* first clack valve
31*z* seal on valve of first clack valve
21 second clack valve
32*a* pilot or part line for second clack valve
33-33' third clack valve (first and second embodiment)
34-34' fourth clack valve (first and second embodiment)
35-35' pilot valve for fourth clack valve (first and second embodiment)
36 pilot valve for second clack valve
37 pilot pressure valve for first clack valve
370 pilot pressure valve with atmospheric relief
38 pilot-operated non-return valve

The invention claimed is:

1. A hydraulic cylinder, for use with a hydraulic tool, which hydraulic tool is provided with a frame and an element which is movable with respect to the frame by means of the hydraulic cylinder, wherein the hydraulic cylinder comprises:

a supply for a pressurized fluid;

one piston/cylinder combination comprising a cylinder body provided with a first, closed end and a second, open end and a piston body accommodated in the cylinder body, provided with a piston rod extending from the second, open end of the cylinder body, wherein the cylinder body and the piston body delimit a first cylinder chamber and the cylinder body, the piston body and the piston rod delimit a second cylinder chamber, wherein the piston rod is hollow and is in fluid communication with the second cylinder chamber near the piston body, and the cylinder body comprises a cylinder rod which extends through the piston body from the first end and into the hollow piston rod and is provided with a cylinder piston body, wherein the cylinder piston body and the hollow piston rod delimit a third cylinder chamber, and wherein in use, the piston body and the cylinder piston body perform alternately outward and inward working cycles on account of pressurized fluid supplied to the first, second and third cylinder chamber, respectively, via a first fluid line, second fluid line, and third fluid line, respectively, as well as at least a first control valve accommodated in a first valve block, which first control valve has two clack valves for controlling the supply of pressurized fluid via the first fluid line and second fluid line to the first cylinder chamber and second cylinder chamber respectively, as well as at least one second control valve which is accommodated in a second valve block, which at least one second control valve controls the supply of pressurized fluid to the third cylinder chamber via the third fluid line, and wherein the first control valve further comprises a pilot pressure valve which controls the opening of the clack valve in the first fluid line, based on a fluid pressure in the second fluid line.

2. The hydraulic cylinder according to claim 1, wherein the first valve block is fitted against and near the open end of the cylinder body.

3. The hydraulic cylinder according to claim 2, wherein the first fluid line from the first valve block is fitted next to the cylinder body and is connected to the first cylinder chamber near the closed end of the cylinder body.

4. The hydraulic cylinder according to claim 2, wherein the second fluid line is partly arranged in the first valve block and is connected to the second cylinder chamber near the open end of the cylinder body.

5. The hydraulic cylinder according to claim 2, wherein the second valve block is fitted against the frame.

6. The hydraulic cylinder according to claim 2, wherein the third fluid line from the second valve block is connected to the third cylinder chamber via the piston rod extending from the open end of the cylinder body.

7. The hydraulic cylinder according to claim 1, wherein the first valve block is connected to the fluid supply by means of rotating fluid couplings.

8. The hydraulic cylinder according to claim 1, wherein the closed end of the cylinder body is coupleable to the movable element of the hydraulic tool and the piston rod extending from the open end of the cylinder body is coupleable to the frame of said hydraulic tool.

9. The hydraulic cylinder according to claim 1, wherein the cylinder rod is provided with a first bore, which first bore is in fluid communication with the second cylinder chamber from the closed end of the cylinder body to near the cylinder piston body.

10. The hydraulic cylinder according to claim 9, wherein the cylinder rod is provided with a second bore, which second bore is in fluid communication with the third cylinder chamber from the closed end of the cylinder body and through the cylinder piston body.

11. The hydraulic cylinder according to claim 9, wherein the second valve block is fitted against the closed end of the cylinder body.

12. The hydraulic cylinder according to claim 11, wherein the first fluid line, second fluid line, and third fluid line, respectively, are partly arranged in the second valve block and connected to the first cylinder chamber, the first bore, and the second bore, respectively.

13. The hydraulic cylinder according to claim 9, wherein the closed end of the cylinder body is coupleable to the frame of the hydraulic tool and the piston rod extending from the open end of the cylinder body is coupleable to the movable element of the hydraulic tool.

14. The hydraulic cylinder according to claim 9, wherein the cylinder body is provided with a protective sleeve.

15. The hydraulic cylinder according to claim 1, wherein the pilot pressure valve is a pilot pressure valve with atmospheric relief.

16. The hydraulic cylinder according to claim 1, wherein the pilot pressure valve cooperates with a pilot-operated non-return valve.

* * * * *